US006044523A

United States Patent [19]

Ortega

[11] Patent Number: 6,044,523

[45] Date of Patent: Apr. 4, 2000

[54] BREAK-AWAY TASSEL AND METHOD

[76] Inventor: Eudelio Ortega, 6250 W. 6th Ave., Hialeah, Fla. 33012

[21] Appl. No.: 09/135,075

[22] Filed: Aug. 17, 1998

[51] Int. Cl.[7] ..... A47B 95/02

[52] U.S. Cl. ..... 16/442; 16/428

[58] Field of Search ..... 160/178.1, 173; 24/115 F, 129 R, 128; 16/442, 441, 422, 428

[56] References Cited

U.S. PATENT DOCUMENTS

| | | | |
|---|---|---|---|
| 948,109 | 2/1910 | Harrigan | 16/122 |
| 5,504,977 | 4/1996 | Weppner et al. | 16/122 |
| 5,518,056 | 5/1996 | Voss | 160/178.1 |
| 5,518,057 | 5/1996 | Huang | 160/178.1 |
| 5,542,461 | 8/1996 | Huang | 24/115 F |
| 5,542,462 | 8/1996 | Elsenheimer et al. | 16/122 |
| 5,715,884 | 2/1998 | Cotten | 160/178.1 |
| 5,823,242 | 10/1998 | Huang | 160/178.1 |

OTHER PUBLICATIONS

American National Standard for Safety of Corded Window Covering Products —ANSI/WCMA A100.1, covering page and page 7 —Published Nov. 1996 by the American National Standards Institute, Inc.

*Primary Examiner*—Chuck Y. Mah
*Attorney, Agent, or Firm*—Jack E. Dominik

[57] ABSTRACT

An end tassel and a separator for blind cords, each of which releasably secures one of the multitude cords in position. The end tassel receives the cord through an opening in which the cord is secured. One such cord, however, on the end tassel is permanently secured in the event the other cords are loosened. If a child or pet should swallow the end tassel, because the one cord is permanently secured, the end tassel can be pulled from the mouth of the child. The separator similarly has openings for multiple cords which permit them to pass upwardly and downwardly. One such opening, however, is securely anchored to the cord to provide for alignment as well as release and loss or being swallowed. In an alternative embodiment, a single cord is permanently secured through a hole in the underside tassel and knotted or otherwise secured in place. The tassel may be of various sizes and so may be the cords. The method of the present invention relates to the provision of a break-away tassel and separator which will cause the cords to be removably secured in place to the end whereby a life threatening tug will displace the cord from the tassel or the separator. Similarly, a single cord may be attached to the break-away tassel, and the tassel and separator have all break-away cords.

15 Claims, 10 Drawing Sheets

BREAK-AWAY TASSEL AND METHOD

FIELD OF THE INVENTION

The present invention relates to cord pulls such as normally employed with horizontal blinds. Exemplary of such cord pulls are products located in U.S. Classes 160/344 and other 160 subclasses, along with International Class A47H.

BACKGROUND OF THE INVENTION

Verticals and horizontals in the blind business for window covering are well known. Currently there is a move toward horizontal blinds. With such blinds it is important to have a cord pull for purposes of both raising and lowering the blind, as well as rotating the same from the full view open position to the closed block view position. This is invariably done by a cord on the left or right side of the blind. The cords normally terminate in a tassel or end tassel at the lower portion. The cords are secured in the end tassel in various means. Where several cords are involved, and a separator is positioned a distance such as one foot above the tassel, it is possible for a small child, crawling on the floor, to place his head inside the loop portion between the tassel and the separator. He may become severely constricted around the throat which can result in injury or even death. Accordingly, it is highly desirable to develop a break-away end tassel and separator which will functionally serve to separate the cords, or multiple cords, required to function while at the same time be able to break-away when a choking-like force is applied by a small child, pet, or other intrusion.

The American National Standards Institute, for safety of corded window covering products, located at 11 West 42$^{nd}$ Street, New York, N.Y. 10036, has developed certain standards for the Window Covering Manufacturers Association directed to such blinds. This is cited as ANSI/WCMA A100.1-1966. The same was published in 1996. The product requirements are set forth on page 6, Item 4. PRODUCT REQUIREMENTS, from 4.1 to 4.6 reading as follows:

"4.1 Any safety component or device that is intended to separate from the product is subject to the requirements of 16 CFR 1501.

4.2 A product shall contain a passive device that eliminates a cord or bead loop, or separates the cord or bead loop, which meets the parameters outlined in 6.1 or 6.3; or 4.3 A product shall contain a permanently attached passive device that eliminates an exposed cord or bead loop while a product is not being operated, which meets the parameters outlined in 6.2; or 4.4 A product shall contain a passive tension device to be attached to the floor or wall causing the cord or bead loop to be taut while limiting exposure to the cords, which meets the parameters outlined in 6.5; or 4.5 A product having a function that requires a cord stop shall be provided with means that minimizes the exposed loop to less than three inches from the top of the headrail when the product is in the lowered position. A warning shall be provided on the product indicating to the user the potential hazard when the product is in the raised position; or 4.6 A product shall contain a material that houses the cord and shields it from exposure, which meets the parameters outlined in 6.4."

The subject invention was developed in the context of the above ANSI specification, as well as the inherent problem involved.

SUMMARY OF THE INVENTION

The present invention derives from the development of an end tassel and a separator, each of which releasably secures one of the multiple cords in position. The end tassel receives the cord through an opening in which the cord is secured. One such cord, however, on the end tassel is permanently secured in the event the other cords are loosened, and a child or pet should swallow the end tassel. Because the one cord is permanently secured, the end tassel can be pulled from the mouth of the child. The separator similarly has openings for multiple cords which permit them to pass upwardly and downwardly. One such opening, however, is securely anchored to the cord to provide for alignment as well as release and loss or being swallowed. In an alternative embodiment, a single cord is permanently secured through a hole in the underside tassel and knotted or otherwise secured in place. With this embodiment, it is entirely impossible to have break-away slots in both the tassel and the separator so that all of the cords disengage, and then the tassel remains controlled by the single string. The tassel and separators are normally molded from a polypropylene or other resilient-type material which has a yieldable and smooth friction-resistant surface. The cords, desirably, are no more than 1.8 millimeters and formed of polyester. The tassel may be of various sizes and so may be the cords. The method of the present invention relates to the provision of a break-away tassel and separator which will cause the cords to be removably secured in place to the end whereby a life threatening tug will displace the cord from the tassel or the separator. Similarly, a single cord may be attached to the breakaway tassel, and the tassel and separator have all break-away cords. Then, if a child should swallow the tassel, there is still a cord for retrieval. The result is that there is only one cord remaining once all of the cords are detached from the separator and the end tassel. This eliminates multiple cords to form a loop which, in turn, can be dangerously engaged about the limbs or the neck of a child.

In view of the foregoing it is a principal object of the present invention to provide an end tassel break-away with a separator break-away in a multiple cord system for operating vertical or horizontal drapes in which the loops at the tassel end of multiple cords, secured in place and guided by a separator, can be easily opened in the event a child or other person, including the family dog or cat, becomes snarled in one of the loops.

A further object of the present invention is directed to an end tassel and separator which permit normal function and normal operation as in the prior art and, therefore, are adaptable to a wide variety of blind configurations.

Yet another object of the present invention is to provide for an end tassel and separator break-away system which adds only marginal or incremental additional expense to the entire assembly once totally installed in a blind configuration.

BRIEF DESCRIPTION OF THE DRAWINGS

The foregoing objects and advantages will be further understood as the following description of an illustrative embodiment takes place, taken in conjunction with the accompanying drawings, in which.

DESCRIPTION OF A PREFERRED EMBODIMENT

Figure 1:
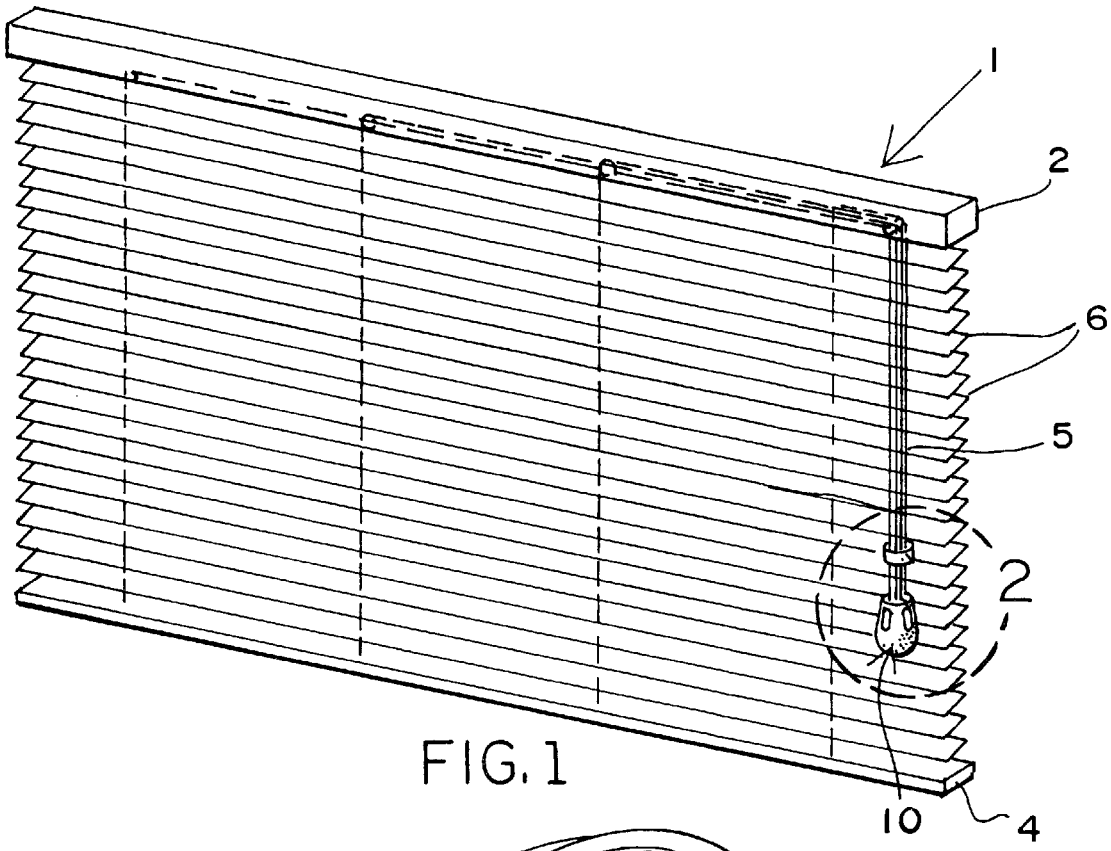
FIG. 1 is a front view of a typical blind installation on a window, the width of which is significantly longer than the height, and in which a multiple cord configuration is employed and showing the break-away end tassel in the lower right-hand corner.

The present invention of a break-away end tassel cord assembly will be best understood by first reviewing the environment as shown in FIG. 1. There it will be seen that a typical horizontal blind installation 1 has been applied to a window. The blind assembly is secured to the upper portion of the window opening at the header 2. The break-away cord control package 5 is secured to the right-hand portion as shown in FIG. 1 and ultimately the cords 30, 35 engage the blind footer 4 to control the angle of the slats 6 as well as the height of the footer 4.

Figure 2:
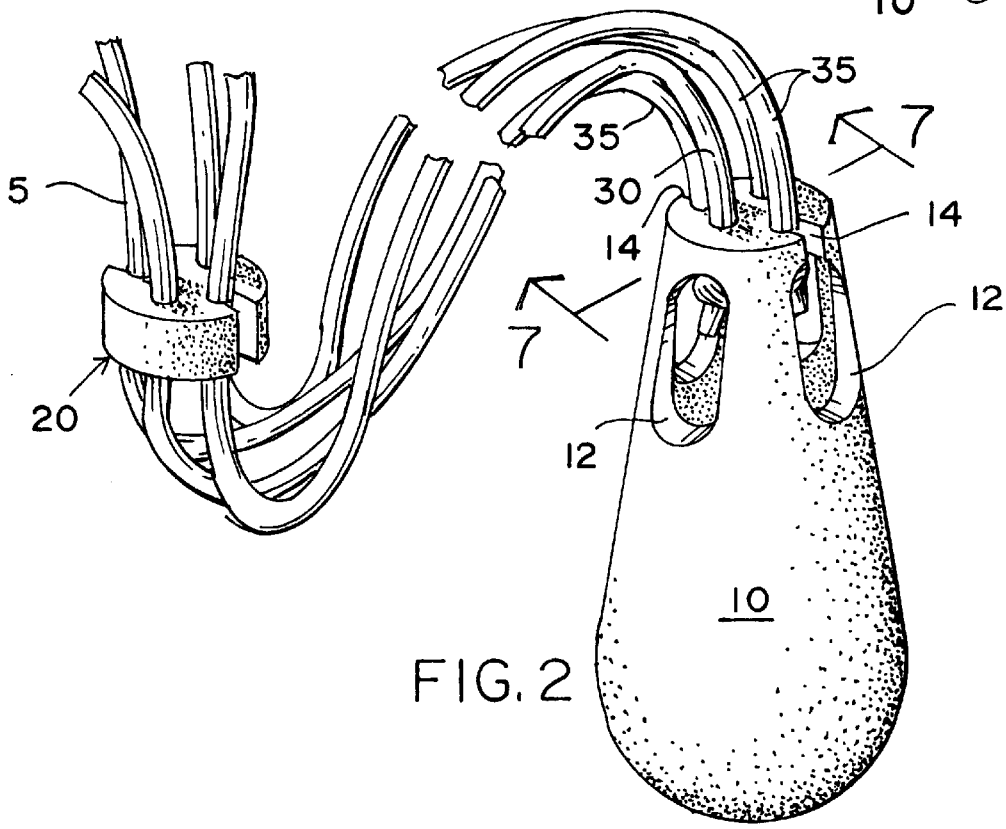
FIG. 2 is an enlarged view of the break-away end tassel in combination with the separator and a plurality of lines.
Figure 3:
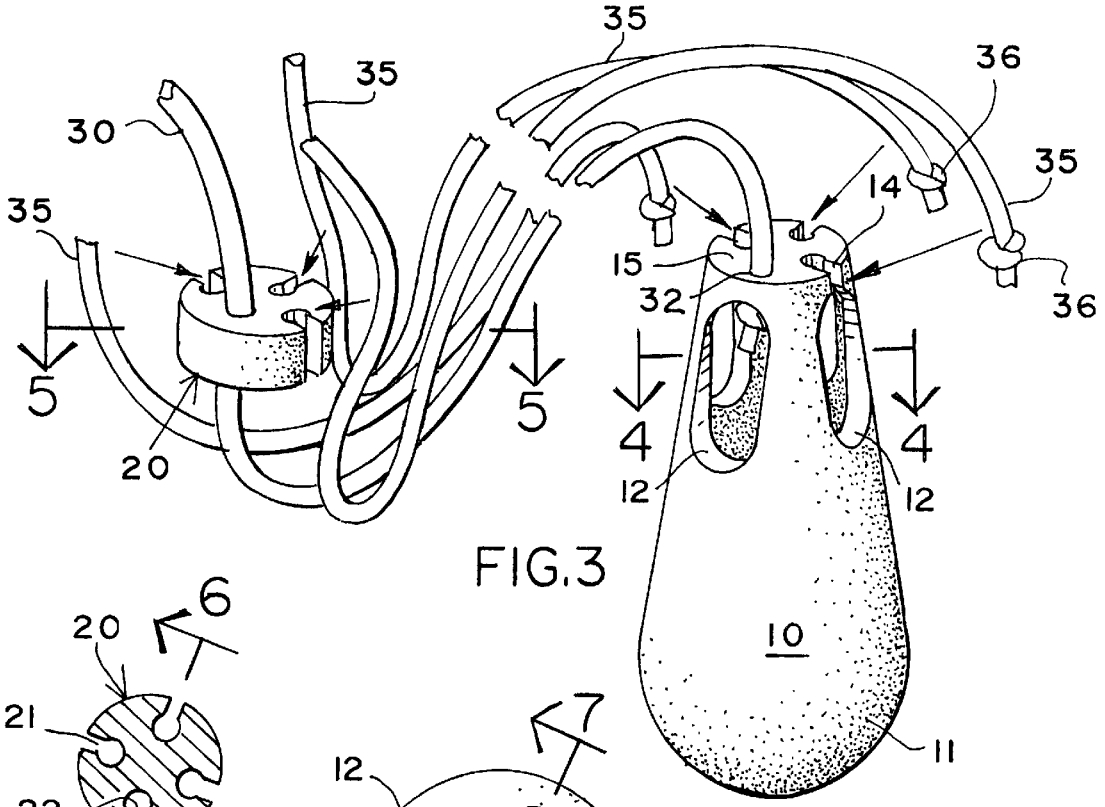
FIG. 3 is an exploded perspective view of the assembly shown in FIG. 2 illustrating diagrammatically with arrows and dotted lines where the various cord elements are secured to the end tassel and the separator.
Figure 5:
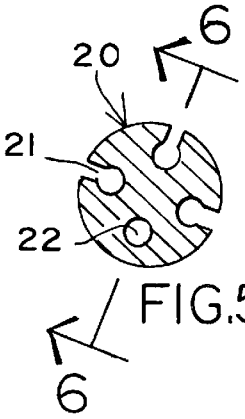
FIG. 5 is a transverse sectional view of the separator taken along section line 5—5 of FIG. 3.
Figure 4:
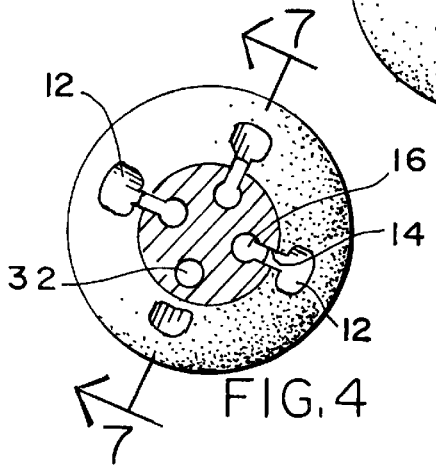
FIG. 4 is a transverse sectional view of the end tassel taken along section line 4—4 of FIG. 3.
Figure 6:
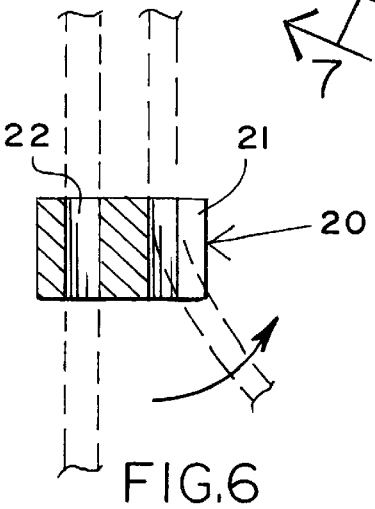
FIG. 6 is a vertical section of the separator taken along line 6—6 of FIG. 5.
Figure 7:
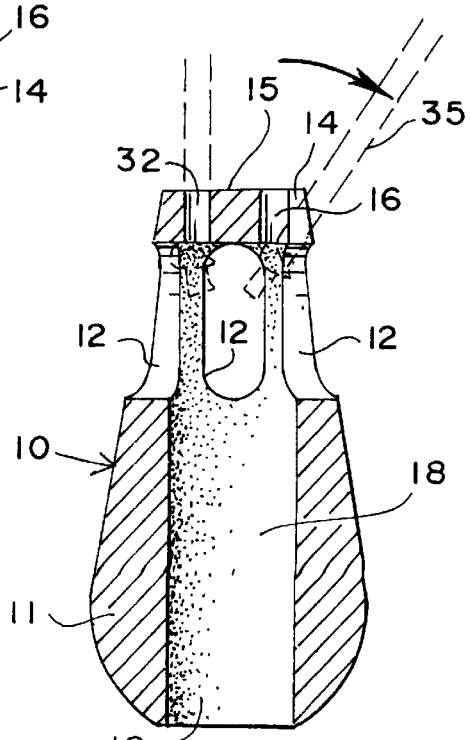
FIG. 7 is an enlarged cutaway view of one of the openings of the separator taken along line 7—7 of FIG. 2.

Turning now to FIG. 2 it will be seen that the break-away tassel 10 (hereinafter tassel) has a tassel body 11 which includes a plurality of knot ports 12. The knot ports 12 are shown as elongated slots being curved at each end. Knot release slots 14 appear above three of the knot ports 12. The fourth knot port terminates at the tassel header 15, the underneath side of which is a knot stop 16. The knot stops 16 are common to all of the knots, but three of the knot stops 16 have a knot release slot 14 to assist in performing the break-away function. The fourth, however, does not have such a slot so that the tassel 10 is retained on its cord as will be explained hereinafter. The chamber 18 permits any cords to pass through bottom chamber 19 for securing the knots 36.

Positioned above the tassel 10 is a separator 20 as shown in FIGS. 2, 3, 5, 6 and 9. The separator is basically a cylinder having four separator slots 21, and one separator stop 22. The separator 20 permits one cord 30 to remain secured to the separator 20 while the break-away cords 35 pull out the separator slots 20.

In operation it must be remembered that there is one fixed cord 30, and three breakaway cords 35. The break-away cords 35 always have a break-away knot 36 at each end which secures them flush with the top of the tassel 10. The fixed cord 30, on the other hand, also does not have a fixed cord knot, which permits the separator to slide up and down the fixed cord 30.

Figure 9:
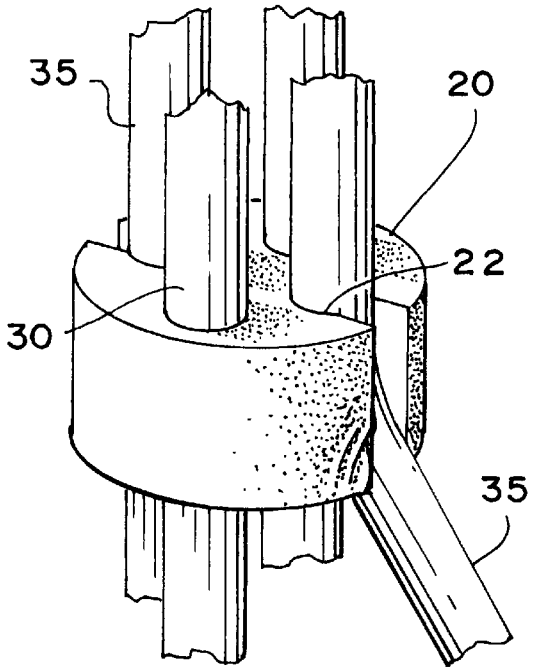
FIG. 9 is an exterior view of the cutaway portion on the separator where the cord is anchored.
Figure 8:
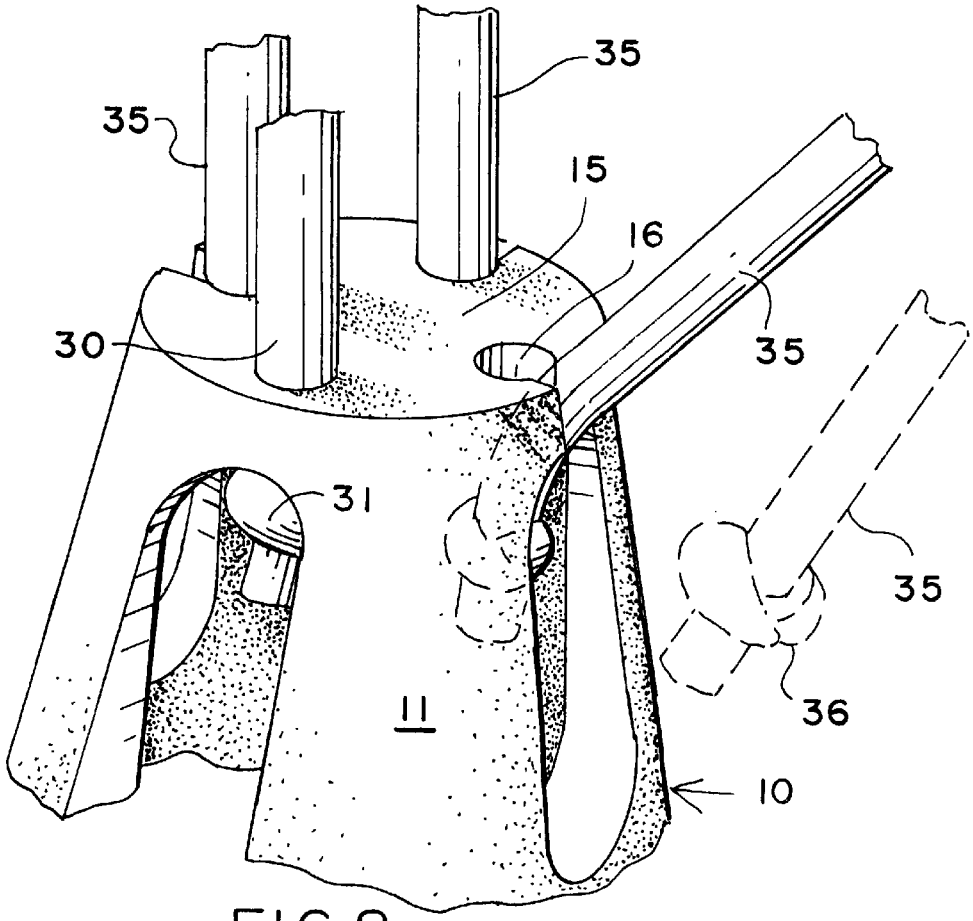
FIG. 8 is an enlarged exterior view of the cutaway portion of the break-away point on the end tassel.

Specifically as shown in FIGS. 8 and 9, when someone becomes entangled in the cord control package 5, which includes the fixed cord 30 and the break-away cords 35, the breakaway cords 35 with their respective break-away knots 36 come out of the tassel body 11 specifically as shown in FIG. 8. Similarly, the break-away cords 35 come out of the separator 20 through the separator slot 20 as shown in FIG. 9. Once all of the break-away cords 35 are out of their respective tassel 10 and separator 20, there remains the fixed cord 30 which is secured to the tassel 10 and the separator 20, having the ability to slide up and down on the separator. Once the break-away cords 35 are stripped away, the risk of entanglement and choking with the single fixed cord 30 is significantly reduced. Alternatively, the fixed cord 30 through the fixed cord knot 31 is secured to the respective tassel 10 and separator 20 so that in the event a child should swallow one or the other, it can be retrieved by pulling on the fixed cord 30. While this is not anticipated in use, the retrieval feature is significant to the present invention.

As shown in FIGS. 14–17, a single cord 60 may be secured to the lower portion of the break-away tassel 10. A hole is provided in the bottom of the tassel 10 for that purpose. Alternatively, with the embodiment utilizing the string 60, all of the cords can be break-away cords 35. Materials are not considered critical to the subject invention, however, the cord material is basically a polyester having a diameter of 1.6 mm to 1.8 mm. The break-away tassel 10 is primarily formed of polypropylene, but may also be formed from wood, or cast from metal.

The keyhole-like slots have a width of three-sixteenths of an inch and a height of five-sixteenths inch, with the slot at the top being one-sixteenths of an inch. The thickness of the material is normally one thirty-secondth of an inch.

Figure 10:
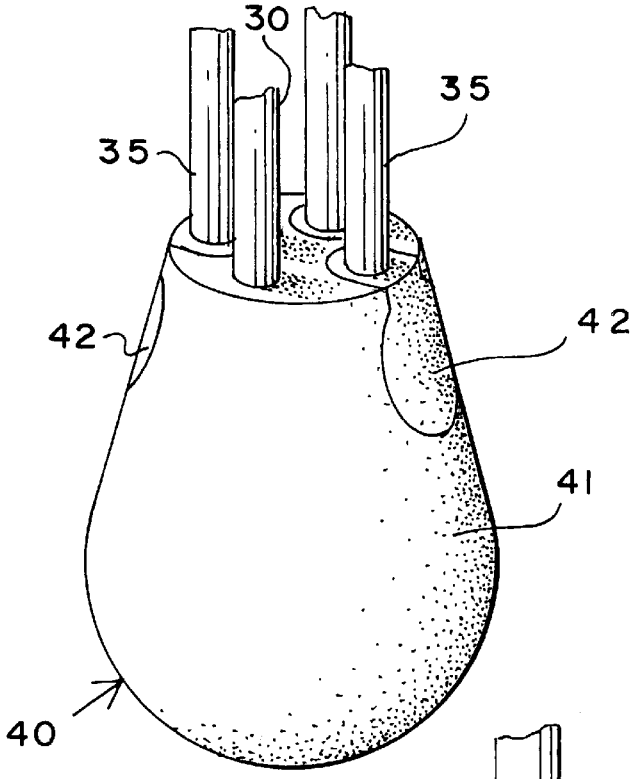
FIG. 10 shows in perspective an alternative embodiment of the break-away tassel.
Figure 11:
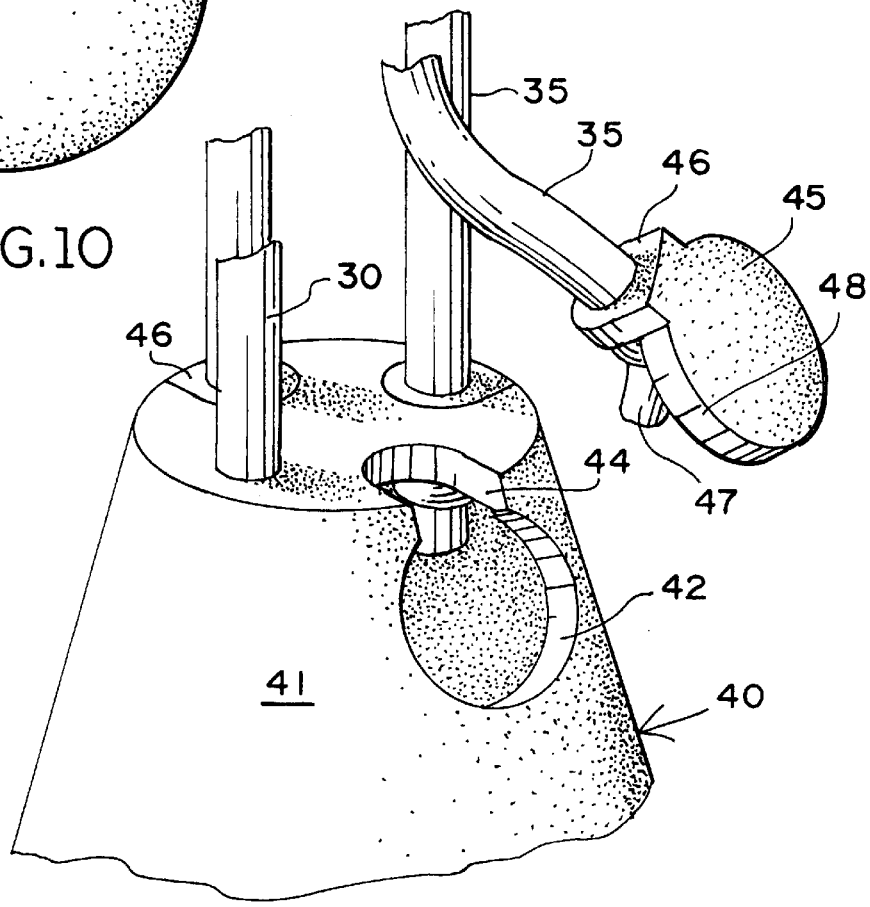
FIG. 11 is a further view of the alternative embodiment break-away tassel shown in FIG. 10 illustrating the break-away clip and its engagement to the tassel. It is also another view of yet another alternative embodiment break-away tassel utilizing a plug.

While we have shown one fixed cord 30 and three break-away cords 35, the fixed cord 30 may be any one of the four cords leading to the control system 5 for the blind 1. The fixed cord end knot 31 and the break-away cord knots 36 are all formed as close to the end of their respective cords 30, 35 as will permit being securely and snugly tied so that they will not become untied in use. The fixed cord 30 passes through the fixed cord port 32. A first alternative embodiment of the subject break-away tassel is shown in FIGS. 10 and 11. There will be seen that the break-away tassel 40 has a body of 41, and a port 42. A groove 44 extends from the port 42 to the upper portion of the break-away tassel body 41. The break-away clip 45 has a knot end hole 46, and the break-away line is secured therein by means of the clip knot 47. The clip body 48 extends downwardly and the entire unit fits entirely and in releasable engagement with the port 42. As with the first embodiment of the break-away tassel 10, there is one fixed cord 30 and a plurality of break-away cords 35.

Figure 12:
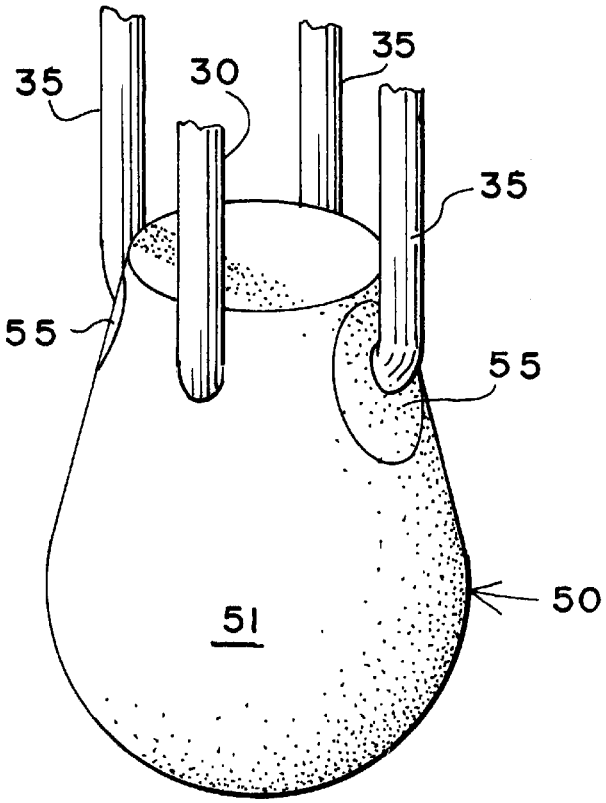
FIG. 12 is a perspective view of a break-away tassel showing yet another alternative embodiment.
Figure 13:
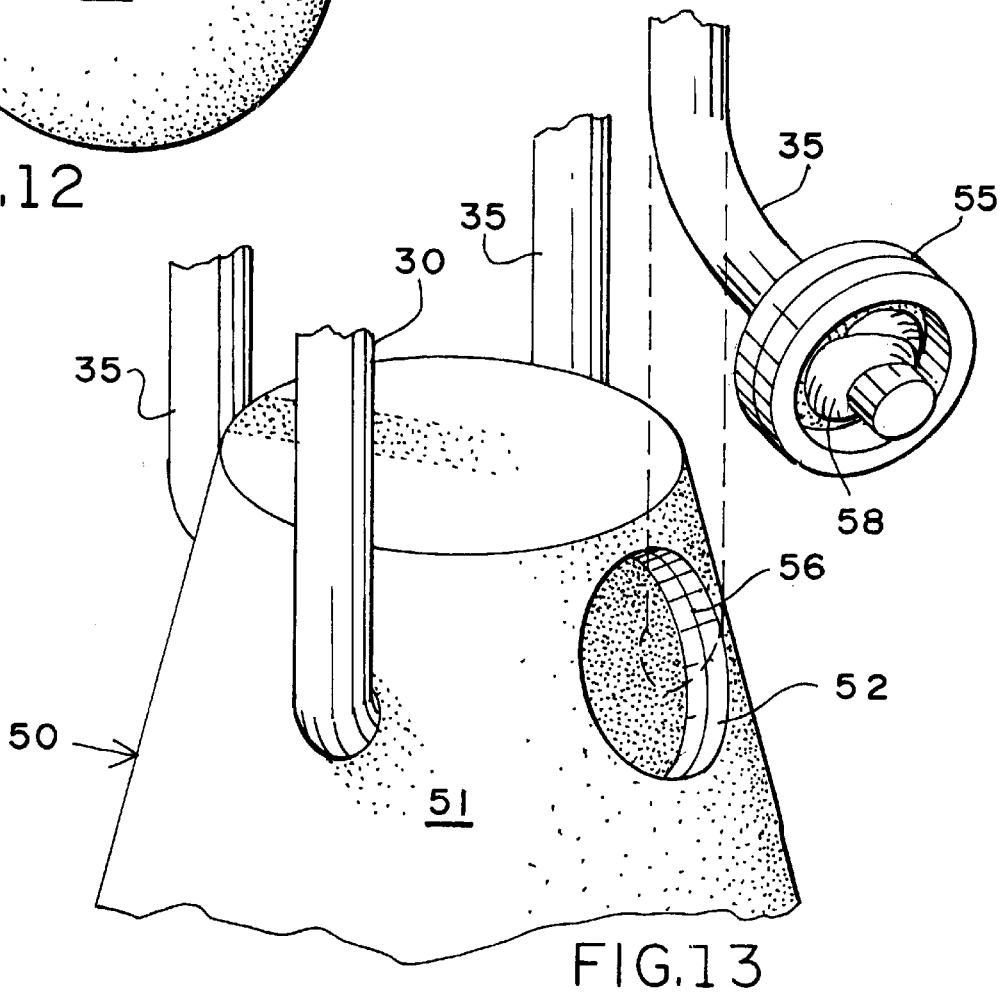
FIG. 13 is an enlarged perspective partially broken view of the alternative embodiment shown in FIG. 12.
Figure 14:
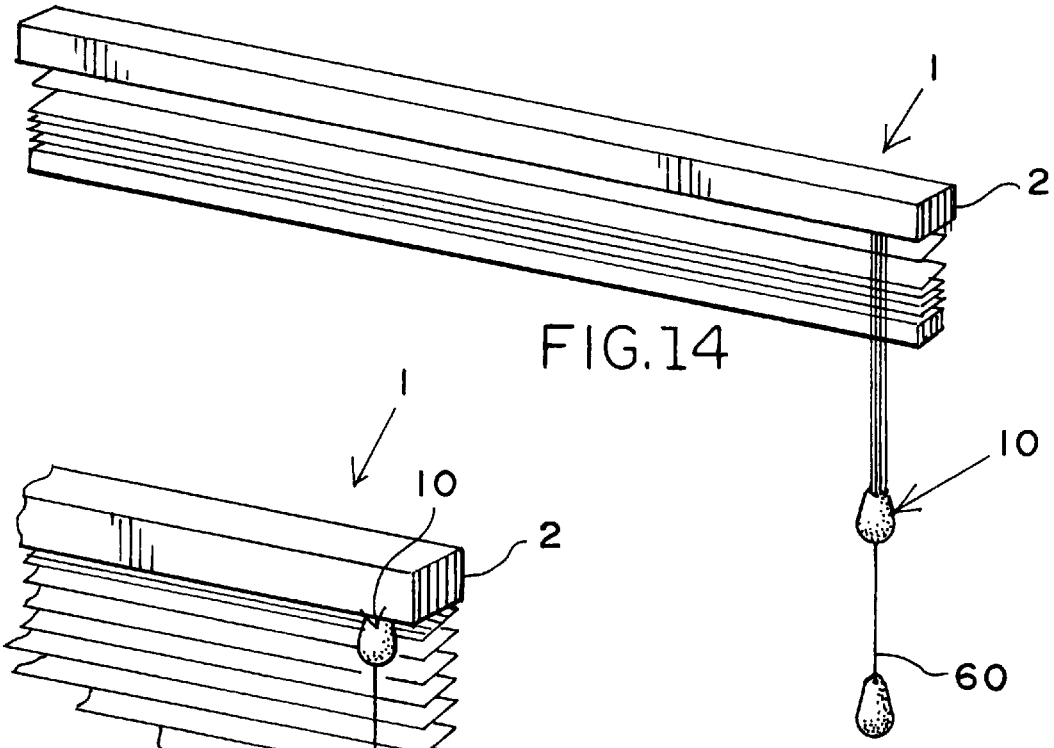
FIG. 14 is a perspective view of a blind partially raised showing an extension cord.
Figure 15:
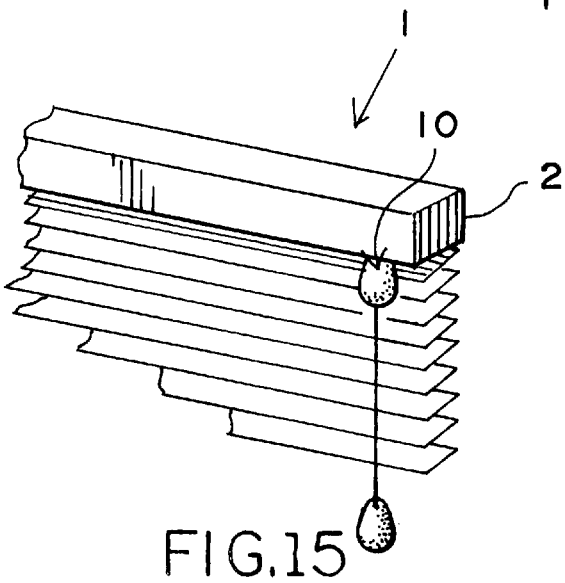
FIG. 15 is an enlarged portion view of the fully raised blind of FIG. 14.
Figure 16:
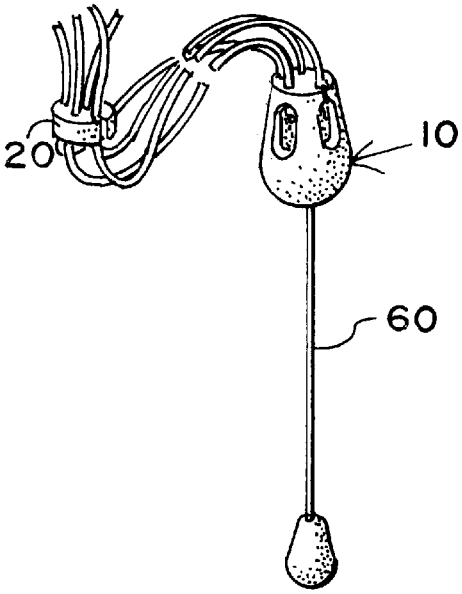
FIG. 16 is yet another embodiment showing the extra cord at the lower portion of one of the break-away tassels.
Figure 17:
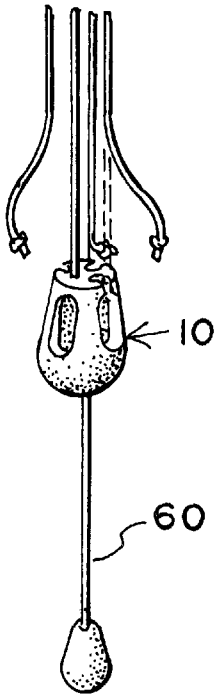
FIG. 17 is a further view of the cord shown in FIG. 16 with the break-away portions broken away and the single securing cord in place.

Yet another alternative embodiment plug tassel 50 is illustrated in FIG. 11 and 12. There will be seen that the plug tassel 50 has a body portion 51 with a plurality of plug holes 52. As with the first embodiment tassel 10, and clip tassel embodiment 40, there is one fixed cord 30 and 3 break-away cords 35. The plug tassel 50, with its plug hole 52, define a plug seat 56 which is engaged by the removable plug 55. The break-away cord 35 is secured into each of the plugs by means of plug knot 58. In FIGS. 14, 15, 16, and 17 a separate pull cord 60 is shown secured to the underneath portion of the break-away tassel. This can be employed with any of the breakaway tassels whether the tassel 10, clip tassel 40, or plug tassel 50.

Figure 18A:
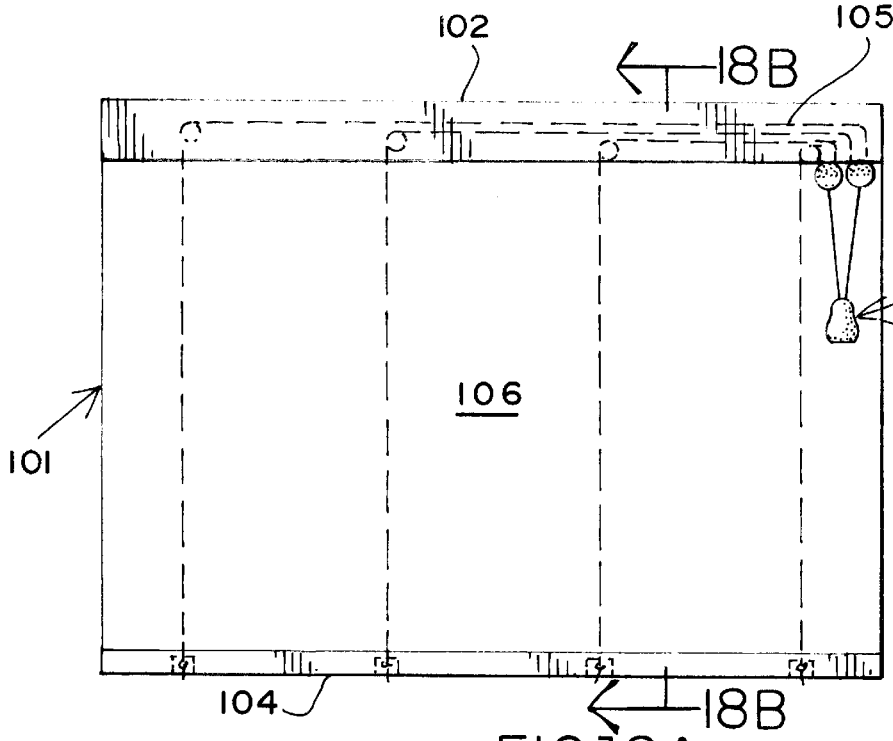
FIG. 18A is the front view of a horizontal pleated bind.
Figure 18B:
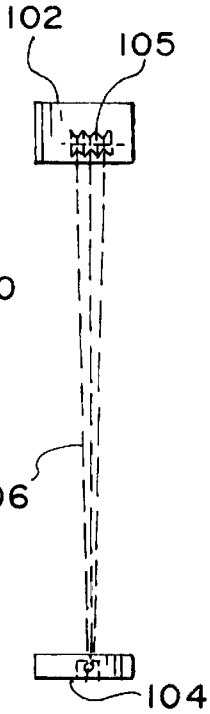
FIG. 18B is a transverse section of the blind shown in FIG. 18A taken along section line 18B—18B of FIG. 18A.
Figure 20:
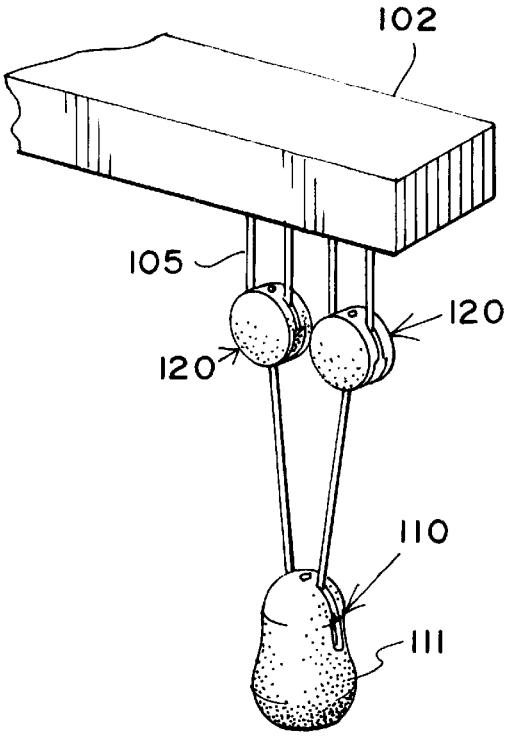
FIG. 20 is a sequential view to FIG. 19 showing the blind in transit, the tassel in transit, and the cords in transit.
Figure 19:
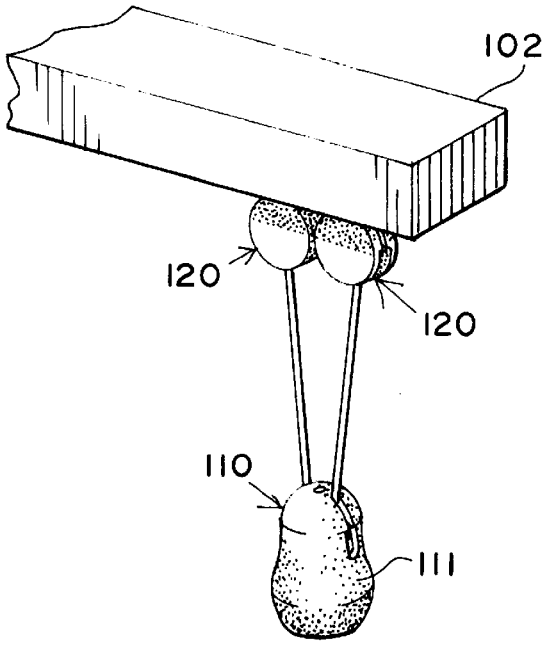
FIG. 19 is a perspective view showing the header and tassel in the fully raised position which means that the blind is in its fully lowered position.
Figure 26:
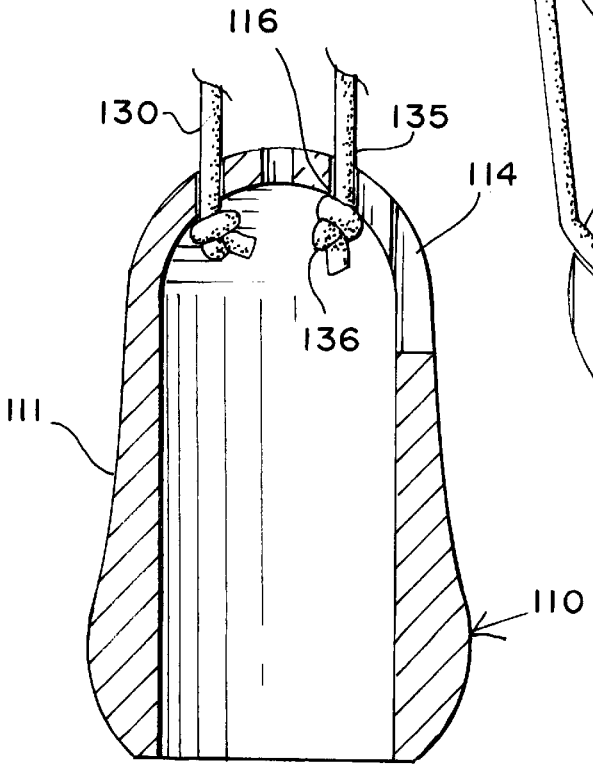
FIG. 26 is transverse sectional view of the tassel shown in FIGS. 24 and 25.
Figure 27:
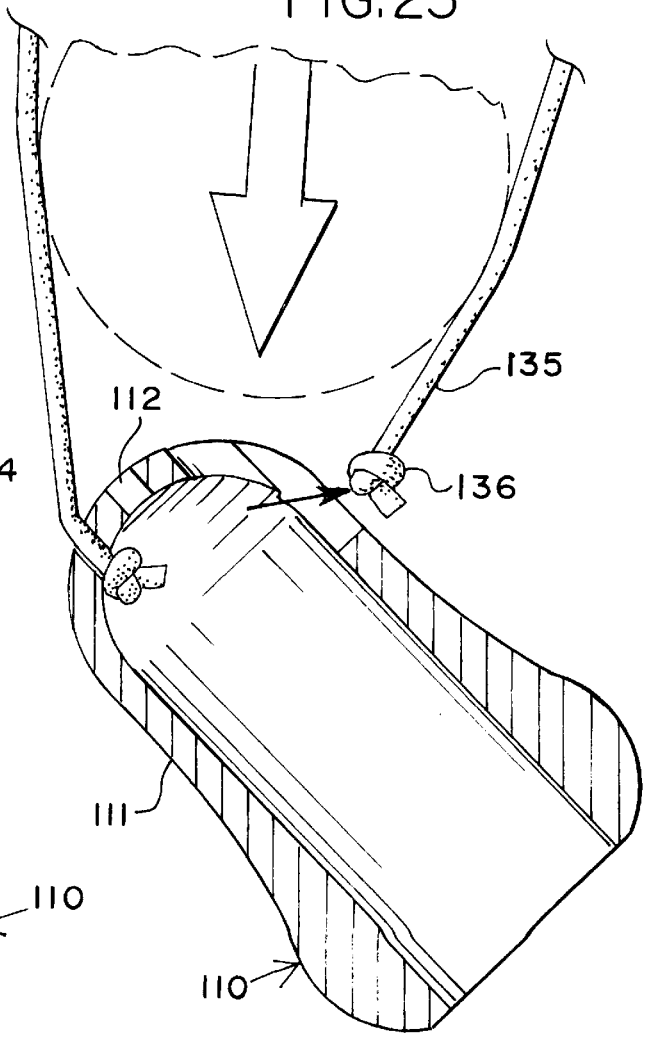
FIG. 27 is a partially diagrammatic view showing the break-away cord coming out of the tassel as was shown in FIG. 26.
Figure 28:
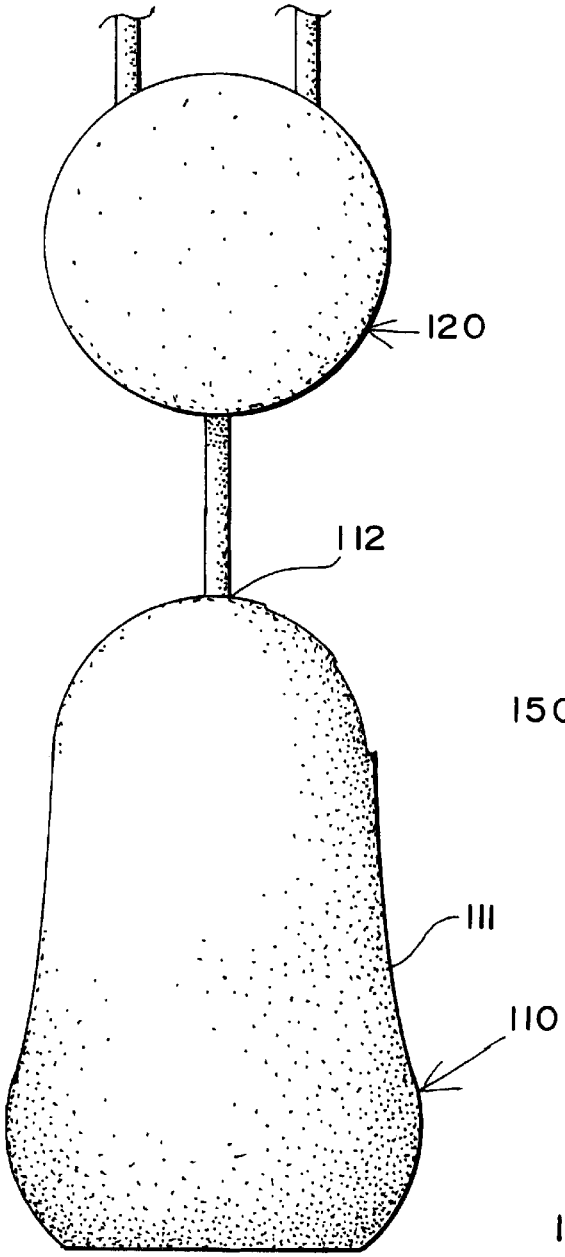
FIG. 28 is a partially diagrammatic view a single fixed cord extending downwardly from the separator to the tassel.
Figure 29:
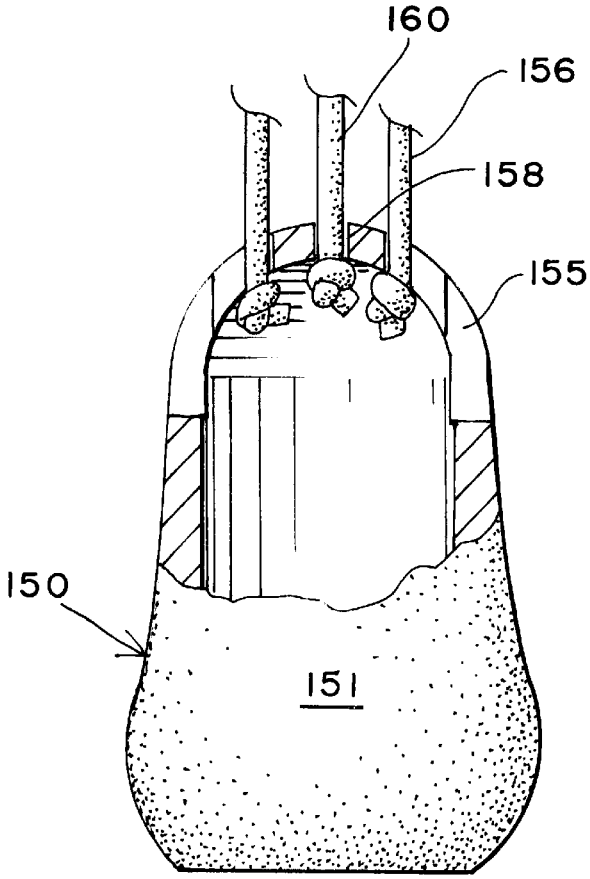
FIG. 29 is a further view but showing a fixed cord and a removable cord extending downwardly to the tassel, much as shown in FIG. 26.

Yet another embodiment of the subject invention is shown in FIGS. 18A–18B through FIG. 29. FIG. 18B generally discloses a blind 101. In describing this embodiment, the prefix 1 is employed with common reference numerals to the preceding embodiments wherever possible. The subject blind 101 has a header 102, and a footer 104. A cord package 105 extends through the header and downwardly toward the tassel 110. The panel 106 may be horizontal individual slats or a full pleated panel such as shown here. More particularly, with reference to FIG. 18B, it will be seen that the header 102 contains four separate guides for the various members of the cord package 105. As the cords extend downwardly, exposed is a fixed cord 130, and a break-away cord 135. In a further embodiment such as shown in FIGS. 28 and 29, a single tasseled cord 140 is also employed. As will be seen in FIG. 19, and in FIGS. 24 through 27, the break-away tassel 110 has a body portion 111. Each is provided with a plurality of ports 112 at the top, with a knot release slot 114 and a knot stop 116. Particularly shown in FIGS. 26 and 27, the removable cord 135 has a removable or break-away knot 136 at its lower portion. When pulled sideways, as illustrated in FIG. 27, the knot 136 and cord 135 break-away from the slot 112 and thereafter the tassel 110 remains secured by the fixed cord 130.

Figure 21:
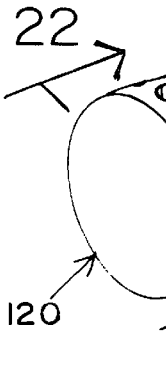
FIG. 21 is a perspective view of the separator of this alternative embodiment.
Figure 22A:
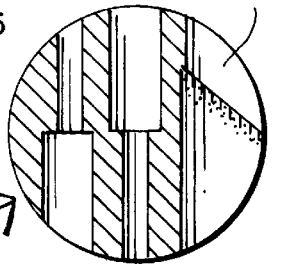
FIG. 22A is a partially sectioned view of the separator shown in FIG. 21.
Figure 22B:
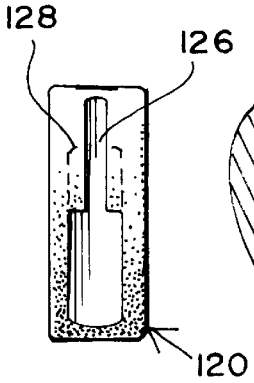
FIG. 22B is yet another broken view of the interior portion of the separator shown in FIG. 22A.
Figure 22C:
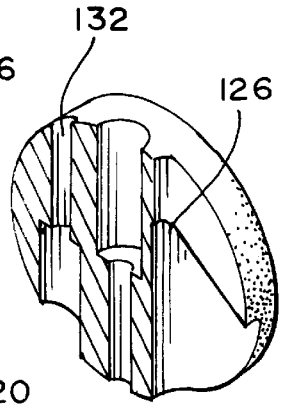
FIGS. 22C and 22D are further views of the separator from different locations.
Figure 22D:
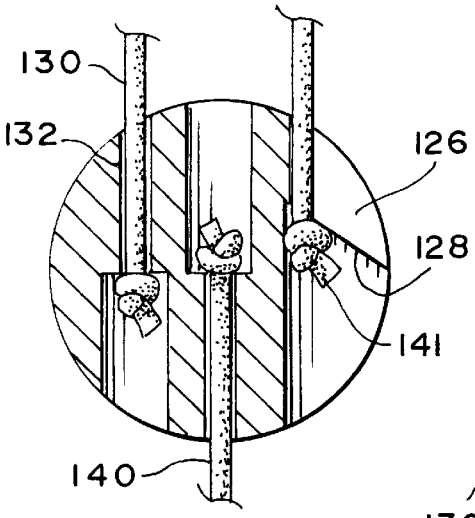
Figure 23:
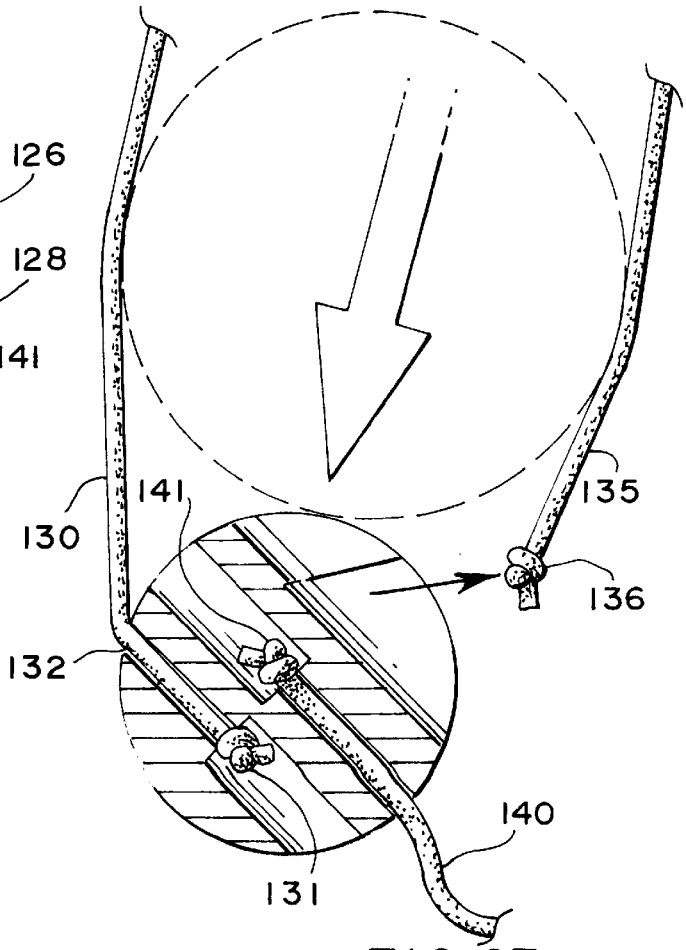
FIG. 23 is a partially diagrammatic view of the modified separator showing the removable cord as it is being dislodged from its secured position.
Figure 24:
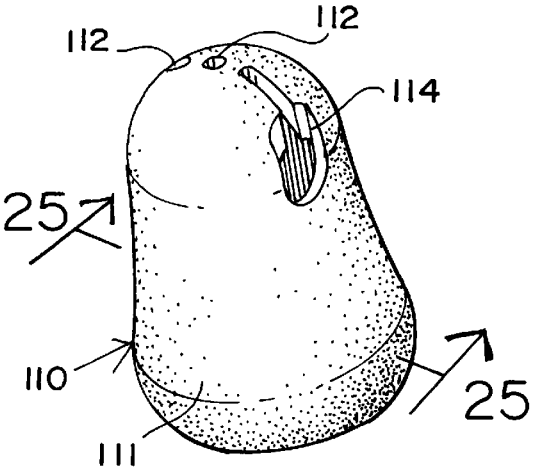
FIG. 24 is a perspective view of the alternative embodiment tassel.
Figure 25:
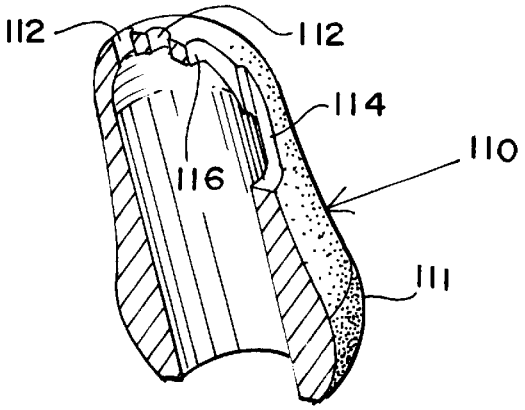
FIG. 25 is a view of the tassel shown in FIG. 24 but partially cut-away to show the openings.

The separator 120 employed is best illustrated in FIGS. 21 through 23. There it will be seen that the break-away separator 120 has a break-away assembly 125 primarily including a slot 126 and an end 128. Thus, when a two-cord system with an active cord 130, such as shown in FIG. 22A as employed, the break-away single cord 140 extends downwardly, with a break-away cord 135, as shown at the right hand side of FIG. 22A. In FIG. 22B, the two ports for the downwardly extending cord 140 and the permanent 130 are shown. FIGS. 22C and 22D show further details, again illustrating that the separator 120 may be provided with a single cord 140 extending downwardly to the tassel, and the break-away occurs with the break-away cord 135 at the separator, with the permanent cord 130 remaining with the separator. In this configuration, should the break-away cord 135 become dislodged, it can always be traced. The permanent cord 130 remain with the separator, and the single cord 140 remains with the tassel. In the even a child should swallow the tassel 110, or the separator 120, the same can be retrieved by gently pulling on the supporting cord.

Figure 30:
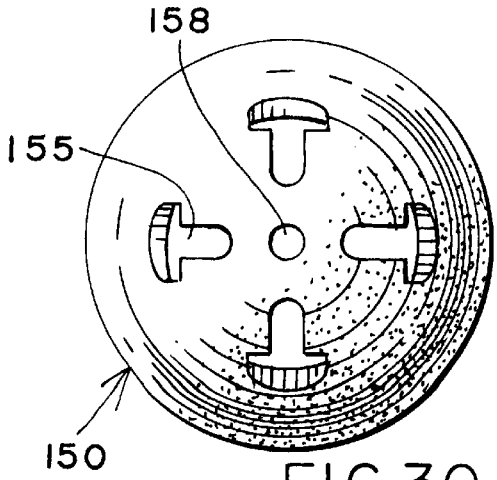
FIG. 30 is a top view of the tassel show FIGS. 28 and 29.

A universal embodiment break-away tassel 150 is shown in FIGS. 29 and 30. The universal break-away tassel 150, in this illustration, is shown as having a body 151, the upper portion of which has a plurality of break-away slots 155 to receive the knotted-in portion of the break-away cords 156. A single cord anchor port 158 is provided at the center portion of the top of the body 151, and an anchor cord 160 is secured thereto. Thus, in this embodiment, four break-away cords can be employed, still with the security of a single anchor cord 160.

The method is generically embodied in all four of the embodiments. In each instance break-away cords and permanent cords are secured to the tassel. In each instance, as well, a tug on any of the break-away cords 35 will remove them from the tassel, and yet the fixed cord will remain secured to the tassel. Once the break-away tassel 10 and separator 20 are formed, the control cords 30, 35 are threaded through the various cord stops 16, 22, then leveled in position, and then finally the ends are cut so that they are essentially flush in cooperation. Once the cutting is concluded, the knots 31, 36 are secured to the cords 30, 35, with the fixed cord 30 threaded through the separator 20 prior to such cutting. It is optional as to when the fixed cord 30 and break-away cords 35 are knotted, but always with the fixed cord 30 passing through the separator 20.

The only departure in the method in the fourth embodiment involves the break-away and permanent cord being a function of the separator 120 rather than the tassel. Nonetheless, the basic proposition of releasing all cords except for one from a potential entrapment noose remains constant.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A break-away tassel cord assembly for use with a blind system for covering an opening in a building structure using multiple cords and a tassel, such assembly being useful for freeing the multiple cords when they become entangled by an intrusion of a pet or child which will be injured by the intrusion without the multiple cords being capable of removal from the tassel, comprising, in combination, a break-away tassel;

said tassel having a plurality of openings for receiving the ends of multiple cords;

a separator;

said separator having a plurality of openings for guidingly receiving said multiple cords which are attached at a position therebeneath to the break-away tassel;

means for securely anchoring one of such multiple cords to the break-away tassel; and means for permanently securing one of the openings in the separator to one of said multiple cords;

whereby any loops formed between the multiple cords where the cords span the space between the break-away tassel and the separator can be removed from the break-away tassel and separator, respectively, by a modest lateral force while the end tassel and separator individually remain permanently secured to one of said cords.

2. In the break-away tassel and cord assembly according to claim 1, said tassel openings having a keyhole-shape with a circular portion and a slot portion for receiving the ends of multiple cords;

whereby the circular portion of the keyhole is enlarged to pass a knot of said cords therebetween and the slot above to break-away said knot when tugged.

3. In the break-away end tassel cord assembly according to claim 1, said tassel openings proportioned to receive a clip;

each of said cords having like member secured to the end thereof;

said clip having means at each end for straddling clip receiving opening provided in the tassel body;

whereby the clips member means are removably engageable by a tug.

4. In the break-away end tassel cord assembly according to claim 1, each of said tassel openings comprising a plug receiving cup like member;

a plurality of plugs one at least secured to the end of each cord; and one of said plugs being proportioned to engage with one opening of the tassel body and the remainder of said plugs being proportioned to removably engage with the remaining openings of said tassel body.

5. A method for securing a plurality of cords having remote control ends to an end tassel and a separator for stringing a blind structure, in which said end tassel has break-away mounting openings and, at least one such opening being for a permanent mounting of at least one cord, and where said separator has break-away mounting slots with one non break-away mount, comprising the steps of:

selecting a cord structure for said plurality of cords for stringing the blind for securement at the remote control ends to the break-away end tassel; and permanently securing one of said cords to the end tassel, and removably securing the other cords to the end tassel.

6. In the method according to claim 5, removably securing all but one of said cords to the separator; and separately permanently securing one of said cords to the separator; whereby the tug on any of the removable cords will disloge the same from the tassel and separator, and yet one of said cords will remain permanently secured to said tassel and the separator.

7. In the method according to claim 5, securing an additional cord to an underneath portion of the tassel; thereby means are provided for retrieving the tassel.

8. In the method according to claim 5, an independent non control cord;

providing means in an underneath portion of the tassel to receive the independent cord; and mounting all of the cords to be break-away cords;

whereby on a strong tug the plurality of control cords disengage from the tassel and the tassel can still be retrieved by locating the individual non control cord.

9. A break-away tassel cord assembly for use with a blind system having multiple control cords for covering an opening in a building structure, comprising, in combination:

a break-away tassel;

said tassel having a plurality of openings for receiving the ends of the multiple control cords;

a separator;

said separator having a plurality of openings for guidingly receiving said multiple cords which are attached at a position therebeneath to the break-away tassel; and means for securely anchoring one of such multiple cords to the break-away tassel;

a separate break-away tassel non control cord;

means for securing all of the control cords in break-away fashion to the tassel; and means for mounting said separate non control cord to the break-away tassel;

whereby a tug can dislodge the tassel from all cords, with a single cord remaining to retrieve the tassel.

10. In the assembly according to claim 9, all of said separator openings being proportioned for permitting all cords to separate from the separator.

11. In the assembly according to claim 10, one of the cords secured to the break-away tassel being secured to the separator;

whereby upon break-away the separator and the tassel remain securely engaged to each other by a single cord.

12. A break-away tassel cord assembly for use with a blind system for covering an opening in a building structure, comprising, in combination:

a plurality of control cords for raising and lowering the blind;

means for directing such cords downwardly toward a break-away assembly;

said break-away assembly including a separator, and a tassel;

at least one of said control cords passing into the separator and secured thereto, and at least another one control cord extending downwardly into the tassel from the separator; and said another such cord removably secured to the separator.

13. A method for securing a plurality of cords to an end tassel and separator for a blind having a panel which is movable, said cords being positioned interiorly of the blind to accomplish opening or closing, and having an end tassel and separator, in which one of said separator and end tassel has a break-away slot, the steps comprising:

providing said separator with a slot for removably receiving a cord having a stop portion at one end;

securing at least one cord permanently to said separator; and securing at least one of the plurality of cords extending from the separator to the end tassel.

14. The method of stringing a horizontal blind having a plurality of pairs of control cords to have break-away tassels, in which said blind has a header, footer, and a blind portion, and in which the header has means for conveying the control cords to an end portion, which said end portion has means for guiding the cords downwardly, comprising the steps of:

providing a pair of separators for each two pair of cords;

anchoring one of said pairs of control cords to each separator, and passing the other pair of cords through the separator in a removably engaged slot formed in the separator;

providing a break-away tassel having a break-away lodging portion for removably securing a knotted end of the cord, and having an aperture for receiving the other end of said cord to permanently secure the same to the break-away tassel;

whereby the horizontal blind is strung in a fashion that becoming entangled with two cords in the break-away tassel will cause one cord to be disengaged from the tassel, while the other cord remains secured to the break-away tassel to facilitate retrieval.

15. In a horizontal blind having a header, and a footer, an a plurality of lifting cords spaced essentially equally between the footer and the header and movably mounted in the header to pass as a cord assembly vertically downwardly to engage a tassel, the improvement comprising:

a separator for separating two cords, one of which can be removed from the separator and the other of which passes downwardly through the separator;

a break-away tassel having a break-away opening and an aperture for permanent affixation of a lifting cord; and one of said cords being secured in the break-away opening in the tassel, the other such cord being secured interior of the tassel;

whereby upon dislodgement, one cord remains permanently fixed to the break-away tassel, the separator, and the blind structure, while the other cord which is disengaged no longer has a loop like relationship with the permanently secured cord.

* * * * *